US009633563B2

(12) United States Patent
Gharsalli et al.

(10) Patent No.: US 9,633,563 B2
(45) Date of Patent: Apr. 25, 2017

(54) INTEGRATED OBJECT DETECTION AND WARNING SYSTEM

(75) Inventors: Ferid Gharsalli, Peoria, IL (US); Clayton D. Reitz, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 1152 days.

(21) Appl. No.: 13/088,740

(22) Filed: Apr. 18, 2011

(65) Prior Publication Data

US 2011/0254700 A1 Oct. 20, 2011

Related U.S. Application Data

(60) Provisional application No. 61/325,714, filed on Apr. 19, 2010.

(51) Int. Cl.
*G08G 1/00* (2006.01)
*G08G 1/16* (2006.01)

(52) U.S. Cl.
CPC ..... *G08G 1/166* (2013.01); *G08G 1/165* (2013.01); *G08G 1/167* (2013.01)

(58) Field of Classification Search
CPC ..... G08G 1/166; G08G 1/165; G08G 1/167
USPC ..... 340/904
See application file for complete search history.

(56) References Cited

U.S. PATENT DOCUMENTS

| | | | | |
|---|---|---|---|---|
| 5,410,304 | A | 4/1995 | Hahn et al. | |
| 5,459,460 | A | 10/1995 | Nishino | |
| 6,014,601 | A | 1/2000 | Gustafson | |
| 6,366,845 | B1 | 4/2002 | Kannonji | |
| 6,430,506 | B1 | 8/2002 | Mon et al. | |
| 6,581,006 | B2 | 6/2003 | Cazzell et al. | |
| 6,753,766 | B2 * | 6/2004 | Patchell | 340/436 |
| 6,789,015 | B2 | 9/2004 | Tsuji et al. | |
| 7,378,947 | B2 * | 5/2008 | Daura Luna et al. | 340/435 |
| 2006/0152351 | A1 | 7/2006 | Daura Luna et al. | |
| 2007/0268155 | A1 * | 11/2007 | Holmes et al. | 340/901 |
| 2009/0229150 | A1 | 9/2009 | Pfohl et al. | |
| 2009/0259400 | A1 * | 10/2009 | Coats et al. | 701/301 |
| 2009/0259401 | A1 | 10/2009 | Edwards et al. | |

FOREIGN PATENT DOCUMENTS

| | | |
|---|---|---|
| GB | 2459889 A | 11/2009 |
| KR | 10-2001-0022537 | 3/2001 |
| KR | 10-2006-0067172 | 6/2006 |

* cited by examiner

*Primary Examiner* — Kerri McNally
(74) *Attorney, Agent, or Firm* — Leonard Stewart

(57) ABSTRACT

In one aspect, an object warning system for a machine is disclosed. The object warning system includes an object detection system and an operator interface having a visual display, and a controller in communication with the object detection system and the operator interface. The controller is configured to control the display to represent a warning level as a function of a status of the machine and a distance of an object relative to the machine.

13 Claims, 3 Drawing Sheets

INTEGRATED OBJECT DETECTION AND WARNING SYSTEM

RELATED APPLICATIONS

This application is based upon and claims the benefit of priority from U.S. Provisional Application No. 61/325,714 by Ferid Gharsalli et al., filed Apr. 19, 2010, the contents of which are expressly incorporated herein by reference.

TECHNICAL FIELD

The present disclosure relates generally to an object detection system and, more particularly, to a system and method for warning of a proximate object.

BACKGROUND

Large machines, such as, for example, wheel loaders, off-highway haul trucks, excavators, motor graders, and other types of earth-moving machines are used to perform a variety of tasks that often involve moving intermittently between and stopping at certain locations within a worksite. In addition, it is not uncommon for objects or obstacles, such as, for example, light duty vehicles, to move and stop near the machine completely unnoticed by the operator. When the object remains unnoticed, the machine may move toward and collide with the obstacle, which ultimately affects the productivity and efficiency of the worksite.

There are known systems that include object or obstacle avoidance and warning systems. For example, U.S. Pat. No. 6,055,042 to Sarangapani (hereinafter "'042") provides a method and apparatus to detect an obstacle in the path of a mobile machine. Nevertheless, '042 and other known systems do not disclose an integrated object detection and warning system that provide a visual warning of a proximate object based on the stopping distance between the machine and the detected object.

The disclosed system is directed to overcoming one or more of the problems set forth above.

SUMMARY

In one aspect, the present disclosure is directed to an object warning system for a machine, including an object detection system, an operator interface having a visual display, and a controller in communication with the object detection system and the operator interface, and configured to control the display to represent a warning level as a function of a status of the machine and a distance of an object relative to the machine.

DETAILED DESCRIPTION

Figure 1:
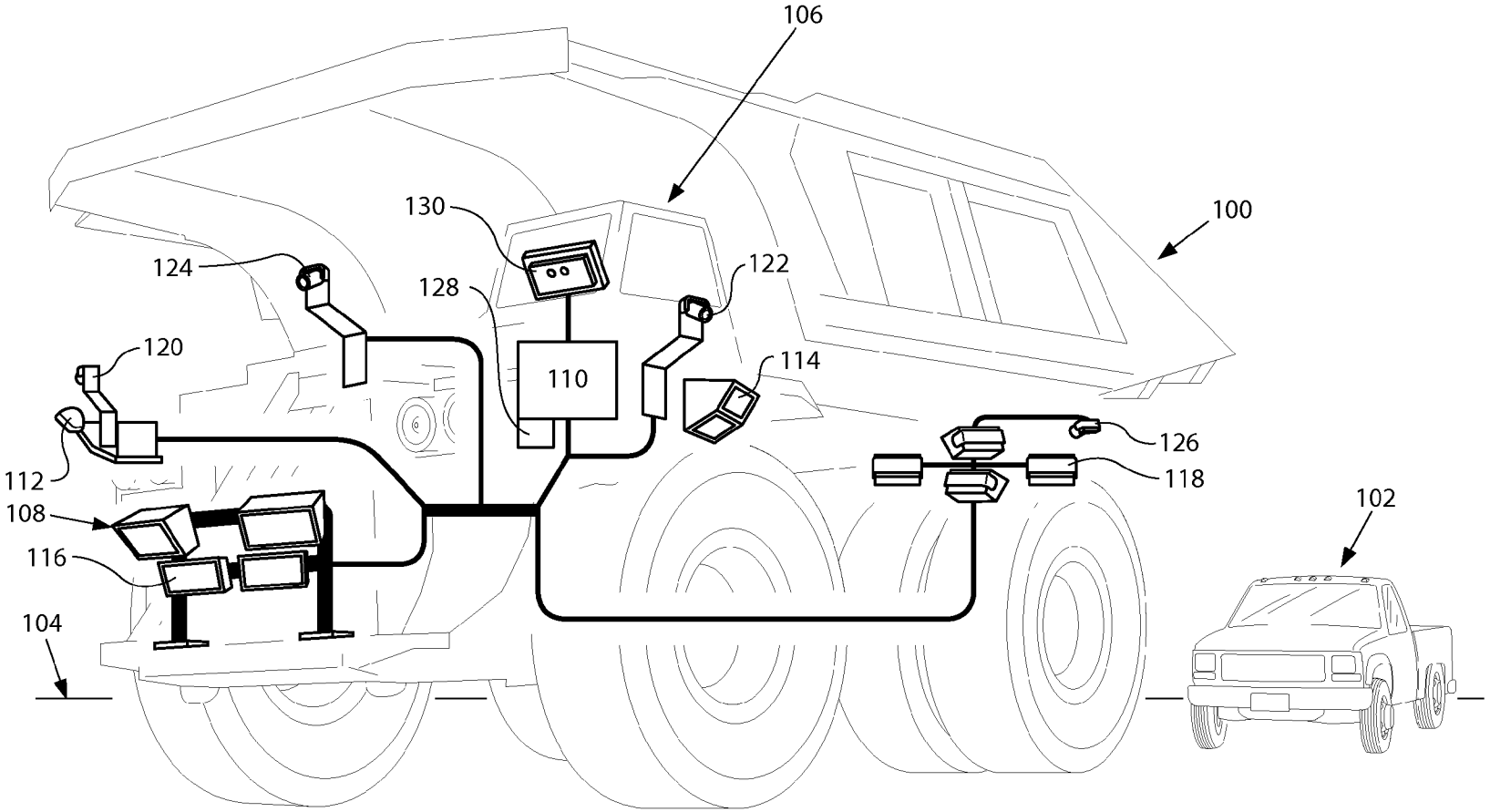
FIG. 1 is a diagrammatic illustration of a machine in accordance with an exemplary embodiment of the present disclosure.

FIG. 1 illustrates an exemplary machine 100 and an obstacle or object 102 in a travel path of the machine 100 located at a worksite 104. Although machine 100 is depicted as an off-highway haul truck, it is contemplated that machine 100 may embody another type of large machine, for example, a wheel loader, an excavator, or a motor grader. The object 102 is depicted as a service vehicle. Nevertheless, it is contemplated that the object 102 may embody another type of obstacle, such as, for example, a pick-up truck, or a passenger car. The object may be any obstacle, such as, for example, rocks and boulders, that is at least a certain size that may present an imminent danger, especially if undetected and may result in a collision with the machine 100. The worksite 104 may be, for example, a mine site, a landfill, a quarry, a construction site, or another type of worksite known in the art.

The machine 100 may have a cab or operator station 106, which may be situated to minimize the effect of blind spots, which are critical areas of the machine 100 having low visibility; however, because of the size of some machines 100, these blind spots may still be so substantial that the object 102 may reside completely within a blind spot that may or may not be viewable by an operator occupying the operator station 106. To avoid a collision with the object 102, the machine 100 may be equipped with an object warning system 108. The object warning system 108 may include a controller 110 to process information about the object 102.

The controller 110 may be disposed within the operator station 106, or within any other assembly of the machine 100. The object warning system 108 may further include an object detection system, such as, for example, a radar system having at least one radar operatively connected to the controller 110 and is configured to detect objects 102 within a predetermined range of distances, as is well known in the art. In the illustrated embodiment, the object warning system 108 includes a plurality of object detection systems 112, 114, 116, 118 mounted on all sides of the machine 100.

The plurality of object detection systems 112, 114, 116, 118 may include near range, medium range, and/or far range radars being configured to detect objects at less than a predetermined distance, i.e. near range, greater than a predetermined distance, i.e. far range, or therebetween, i.e. medium range. Other typical obstacle detection sensors (not shown) may be included without departing from this disclosure, such as, for example sonar systems, laser systems, optical systems, and infrared systems.

Additionally, or alternatively, the controller 110 may be operatively connected to a vision system including at least a camera to capture images in areas within the camera's field of view and in the critical areas of the machine 100, such as blind spots. In the illustrated embodiment, the object warning system 108 includes a plurality of cameras 120, 122, 124, and 126 mounted on all sides of the machine, for example, at the sides, front, and back of the machine to provide images to the controller 110 captured from around the machine 100 and to aid the operator's awareness of the surroundings of the machine 100. In some embodiments, the vision system may be operable or controllable using a separate dedicated control module for independent and redundant functioning from, for example, the radar system.

The controller 110 may also be operatively connected to an interface module 128 to determine a status of the machine 100. The interface module 128 may include, for example, a plurality of sensors distributed throughout the machine 100 and configured to gather data from various components and subsystems of the machine 100. The sensors may be associated with and/or monitor a power source, a transmission, a traction device, a steering device, and/or other components and subsystems of the machine 100. Sensors may measure and/or detect a status of the machine 100 based on the gathered data, such as, for example, a ground speed, a distance traveled, a gear selection of the transmission, a steering angle, or an ambient light level. The interface module 128 may be configured to generate and communicate to the controller 110 a signal corresponding to the status of the machine 100.

The controller 110 may communicate to the operator via an operator interface 130. In addition, the controller 110 may use the operator interface 130 to communicate to the operator a visual representation of the worksite 104 to the operator, such as, for example, using a map to indicate a location of the object 102 detected. The controller 110 may also use the operator interface 130 to provide a warning to the operator and/or acknowledge the operator's recognition of this warning. The controller 110 may store information about object 102 detections. The controller 110 may be configured for monitoring, recording, storing, indexing, processing, and/or communicating information.

The controller 110 may include, for example, a memory, one or more data storage devices, a central processing unit, and/or another component that may be used to run the disclosed applications. Furthermore, although aspects of the present disclosure may be described generally as being stored in memory, one skilled in the art will appreciate that these aspects can be stored on or read from different types of computer program products or computer-readable media such as computer chips and secondary storage devices, including hard disks, floppy disks, optical media, CD-ROM, or other forms of RAM or ROM.

Each camera 120, 122, 124, 126 may generate and communicate to the controller 110 a signal corresponding to captured images. It is contemplated that the controller 110 may communicate with the operator interface 130 to display these captured images to the operator. The operator interface 130 may be disposed within the operator station 106 and may be viewable, and operable by the operator. For example, the operator interface 130 may be mounted to a dashboard of the machine 100 within reach of the operator.

Figure 2:
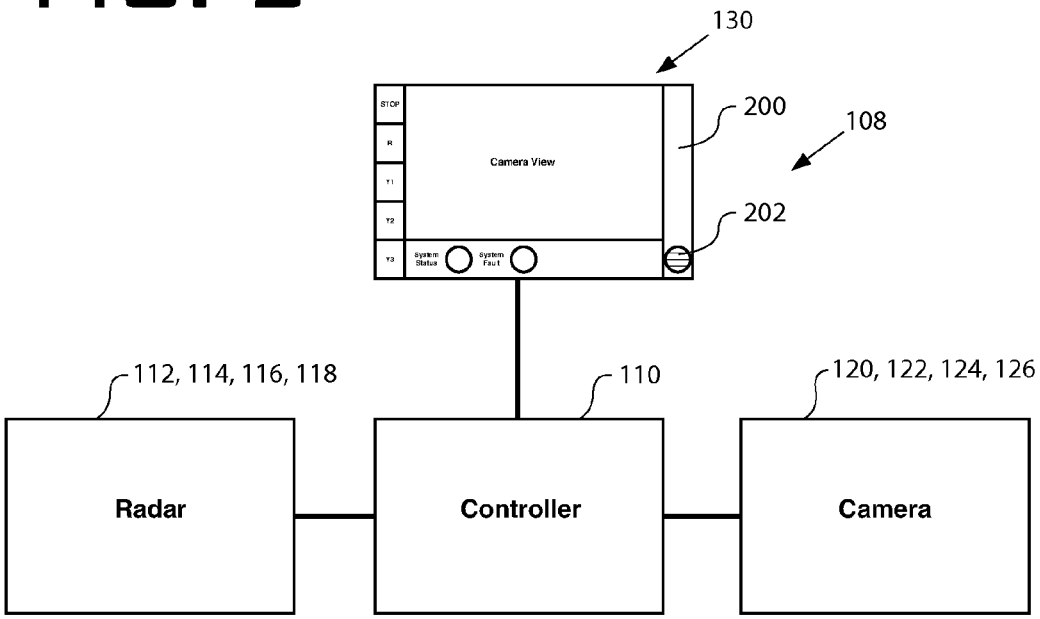
FIG. 2 is diagrammatic illustration of an exemplary control system for use with the machine in FIG. 1 in accordance with an exemplary embodiment of the present disclosure.
Figure 3:
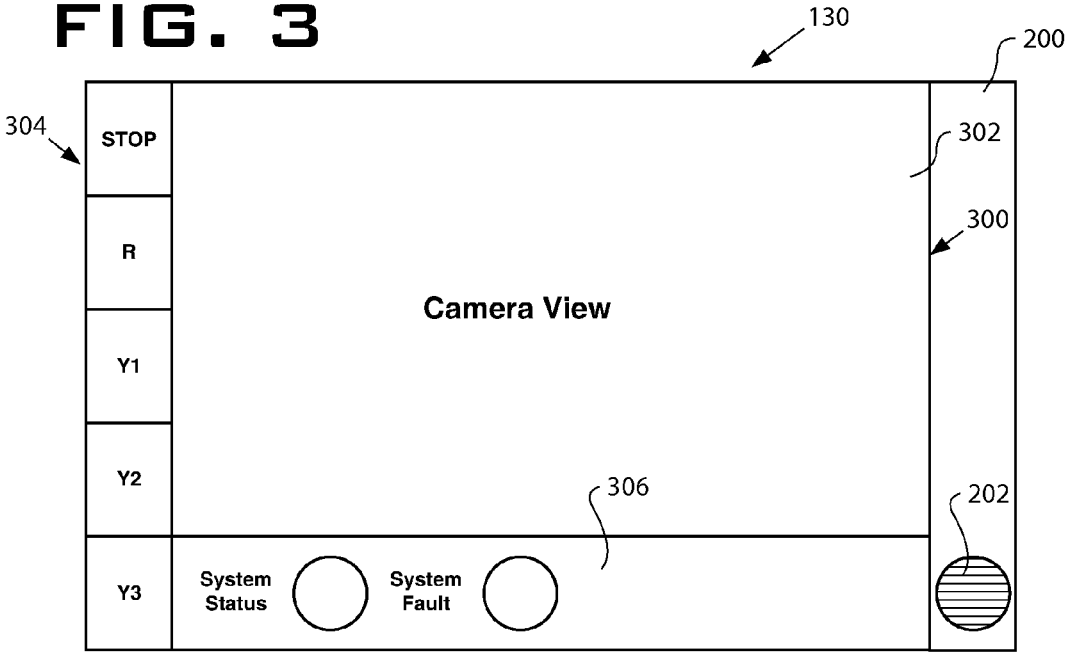
FIG. 3 is a diagrammatic illustration of an operator interface in accordance with an exemplary embodiment of the present disclosure.

As illustrated in FIGS. 2 and 3, the operator interface 130 may include a control panel 200 having at least one input device (not shown) to receive a selection or input from the operator. This selection may serve to acknowledge the operator's recognition of a provided proximate object 102 warning. The input device may embody, for example, a rocker switch, a hat switch, a joystick, a button, and/or another device capable of receiving a selection from the operator and generating a corresponding signal.

Alternatively, or additionally, the operator interface 130 may include an audible device 202, such as, for example, a speaker, to provide an audible proximate or near object 102 warning to the operator. The audible device 202 may embody, for example, an alarm or a horn. It is also contemplated that other devices (not shown) may be used to provide a warning to or to alert the operator of a proximate or near object 102, such as, for example, an odorant or tissue-irritating substance dispenser, or any other known device operable to provide a warning to the operator.

The operator interface 130 may further include a display 300 to display images, as shown in FIG. 3. The illustrated embodiment includes for example, an interactive touch-screen display, in which the display 300 and input device may together embody a single integral component. The display 300 may further embody, for example, a monitor, an LCD screen, a plasma screen, a screen of a handheld device, or another device capable of communicating visual information to the operator. The display 300 may display the visual representation of the map. The controller 110 may use the visual representation of the map to provide a visual warning to the operator, for example, to show a location of the object 102 relative to a location on the map.

It is contemplated that the controller 110 may operate the display 300 in one or more modes corresponding to varied machine 100 operations. For example, a mixed mode may be utilized during normal operations to provide to the operator a breadth of operational and environmental information. When the object 102 is detected within a certain blind spot, a camera mode may be utilized to provide to the operator focused information regarding that certain blind spot. The operator may activate the camera mode in response to the provided proximate object 102 warning, and thereby acknowledging the proximate object 102 warning.

The controller 110 may further operate the display 300 according to system modes or system states that are associated with or that correspond to predetermined modes of machine 100 operations. For example, the object warning system 108 may be adapted to operate in an "on" state when the machine 100 moves in a backward direction, i.e. the controller 110 may receive a gear selection signal indicative of a reverse signal or command, or when the machine 100 is not moving, i.e. when the machine 100 is idle or ground speed is determined to be zero.

The object warning system 108 may be adapted to operate in a "standby" state when the machine 100 moves in a forward direction, for example, at a predetermined ground speed i.e. ground speed greater than zero, or after moving a predetermined distance from a location of the machine 100 when idle. The object warning system 108 may return to the on state from the standby state when the machine 100 is stopped, i.e. ground speed is zero, and/or while the machine 100 is travelling in the forward direction and the machine 100 is caused to change directions to move in the reverse direction, i.e. the controller 110 may receive the reverse signal or command.

The object warning system 108 may be further adapted to operate in a "transition" state when the machine 100 for example is changing operation modes and/or the object warning system 108 is changing states. The object warning system 108 may operate in the transition state when the machine changes from the reverse direction to the forward direction. In some embodiments, the controller may operate the display 300 such that only a camera view is available during the transition state. In other embodiments, when the object warning system 108 is in the standby state, the display 300 may be dimmed, and information and/or images associated with the radar system may not be available. In addition, when the object warning system 108 is in the standby state, the images associated with the vision system may not be available, i.e. the camera view may be unavailable.

It is further contemplated that the controller 110 may operate the display 300 using a plurality of display screens to provide access to varied information associated with the machine 100 or the object warning system 108. The display 300 may also use the plurality of display screens to allow the operator to interact with the operator interface 130 and thereby interact with and/or control the object warning system 108. The display 300 may be operable to allow the operator to navigate from one screen to another, such as, for example by using the touch-screen interface. Each of the plurality of display screens may be adapted to have a uniform layout or a predetermined layout that conforms to the type of information provided.

Each of the plurality of display screens may be adapted to perform a predetermined function or to provide a predetermined type of information. For example, the display 300 may include a first screen that functions as a main screen or default screen that allows the operator to monitor object warning system 108 operations and to interact with the object warning system 108 to facilitate object 102 detection. The display 300 may further include a second screen that functions as a configuration screen that allows the operator to adjust object warning system 108 parameters, such as, for example, to adjust languages, and/or to change or customize display characteristics, colors, orientations, predefined system states, and other known parameters, and/or to access system settings information and/or software program information. The display 300 may further include a third screen that functions as a fault summary screen that provides information associated with system faults and events to the operator or a service technician. For example, system information may include a fault is present on one or more components of the object warning system 108.

In some embodiments, each of the plurality of display screens may be adapted to operate in a view mode or an edit mode. In some embodiments, the view mode may also be operable to allow the operator to interact with the display 300 in known manners, such as, to zoom in on the detected object 102, and the controller 110 may be responsive to that interaction to change the display 300 accordingly. In some embodiments, the display 300 may further be operable to allow the operator to navigate between screens or to interact with the display 300 of the operator interface 130 only when the machine 100 is in a predetermined mode of operation, for example, only when the machine 100 is idle or if a parking brake is applied. The controller 110 may operate the display 300 to automatically change from the configuration screen or the fault summary screen to the display screen when the machine 100 is in motion.

As shown in FIG. 3, the controller 110, for example, on the main screen, may devote a first portion 302 of the display 300 to the camera view 302 for providing images captured by any camera 120, 122, 124, 126. In the illustrated embodiment, the camera view 302 allows the operator to see, for example, the view from the rear camera 126. In some embodiments, the camera view 302 embodies about 90 percent of the main screen of the display 300. In addition, the controller 110 may devote a second portion 304 to a visual warning indicator 304. And, the controller 110 may devote a third portion 306 of the display 300 to a system status indicator for providing the object warning system 108 status and fault information.

The controller 110 may operate to control the visual warning indicator 304 as a function of the object detection system 112, 114, 116, 118 and a position or a gross position of the detected object 102 relative to the machine 100. The controller 110 may control the visual warning indicator 304 to provide a visual indication to the operator where is the position of the object 102 relative to the machine 100. The visual warning indicator 304 may be located on a side of the display 300. In the illustrated embodiment, the visual warning indicator 304 is on the left side of the display 300. It is contemplated that the visual warning indicator 304 may be located on any side of the display 300 or at the top or bottom of the display 300 or any where on the display 300 without departing from the scope of this disclosure. It is further contemplated that the visual warning indicator 304 be provided on a separate display or, for example, on the operator interface 130 itself, or in any known manner.

The visual warning indicator 304 may embody a plurality of contiguous blocks. In the illustrated embodiment, the visual warning indicator 304 includes five contiguous blocks. It is contemplated that the visual warning indicator 304 may embody any shape, e.g. circles, or any quantity and may be arranged with any degree of adjacency without departing from the scope of this disclosure. The visual warning indicator 304 may operate in one of a plurality of color schemes based upon the status information, for example, communicated by the interface module 128 and/or based upon information processed by the controller 110. For example, the controller 110 may vary an appearance or a color of each of the blocks to indicate the varying proximity or nearness of the object 102 relative to the machine 100, as is discussed in more detail below. In the illustrated embodiment, the five blocks represent five warning levels corresponding to a stopping distance from the machine 100 to the detected object 102. The controller 110 may determine the stopping distance according to ISO 3450 and using the ground speed of the machine 100.

For example, in the illustrated embodiment, the block Y3 will show a solid green if there is no object 102 detected in the range of the radars 112, 114, 116, 118. The block Y3 will show a solid yellow if the object 102 is detected in a predefined or predetermined first caution level zone. The two blocks Y2 and Y3 will show a solid yellow if the object 102 is detected in the a predefined or predetermined second caution level zone. The three blocks Y1, Y2, and Y3 will show a solid yellow due to the object 102 detection in the a predefined or predetermined third caution level zone.

If the object 102 is detected in a predefined or predetermined critical zone, the block R and the three blocks Y1, Y2 and Y3 will show red. The controller 110 may cause the blocks R, Y1, Y2, Y3 to flash intermittently or blink with a frequency, for example, of 1 Hertz in case the object 102 is detected in the critical zone. Finally, if the object 102 is detected in a predetermined or a predefined stop zone, the stop and R blocks together with the three blocks Y1, Y2 and Y3 will show a solid red.

The visual warning indicator 304 may be applied if the object 102 is detected while the object warning system 108 is in the on state, either moving backward or not moving. The controller 110 may operate the audible device 202 to provide an audible warning if the object 102 is in the critical zone or the stop zone. In some embodiments, the controller 110 may operate the audible device 202 to give a continuous sound, such as, for example, a continuous beep, if the object 102 is detected in the stop zone. The continuous sound may continue until the operator applies the service brake and the machine 100 stops or the operator changes the direction the machine 100 is traveling.

Alternatively, or additionally, the controller 110 may operate the audible device 202 to give a sound, such as, for example, an intermittent beeping sound, with a frequency that is related to or proportional to the distance of the object 102 relative to a point on the machine 100. The beeping sound may have a frequency that is inversely proportional to the distance of the object 102 with respect to a closest point on the machine 100. In some embodiments, the controller 110 operates the object warning system 108 to provide warnings according to the closest object 102 to the machine 100 when multiple objects 102 are detected. As discussed above, the audible warning will shut down only if the machine 100 stops, i.e. ground speed is zero or, for example, the gear changed direction from backward to forward.

INDUSTRIAL APPLICABILITY

The disclosed object warning system and method may be applicable to machines, which may intermittently move between and stop at certain locations within a worksite. The system may detect information about an object within an area of low visibility of the machine, and report this information to an operator of the machine. In particular, the disclosed system may detect a presence of a proximate object within in the travel path of the machine and warn the operator of this presence. There are five levels of warning based on the stopping distance between the machine and the detected object. The operator interface will use a display and an audible alarm to indicate to the operator the highest warning level present. Operation of the system will now be described.

Figure 4:
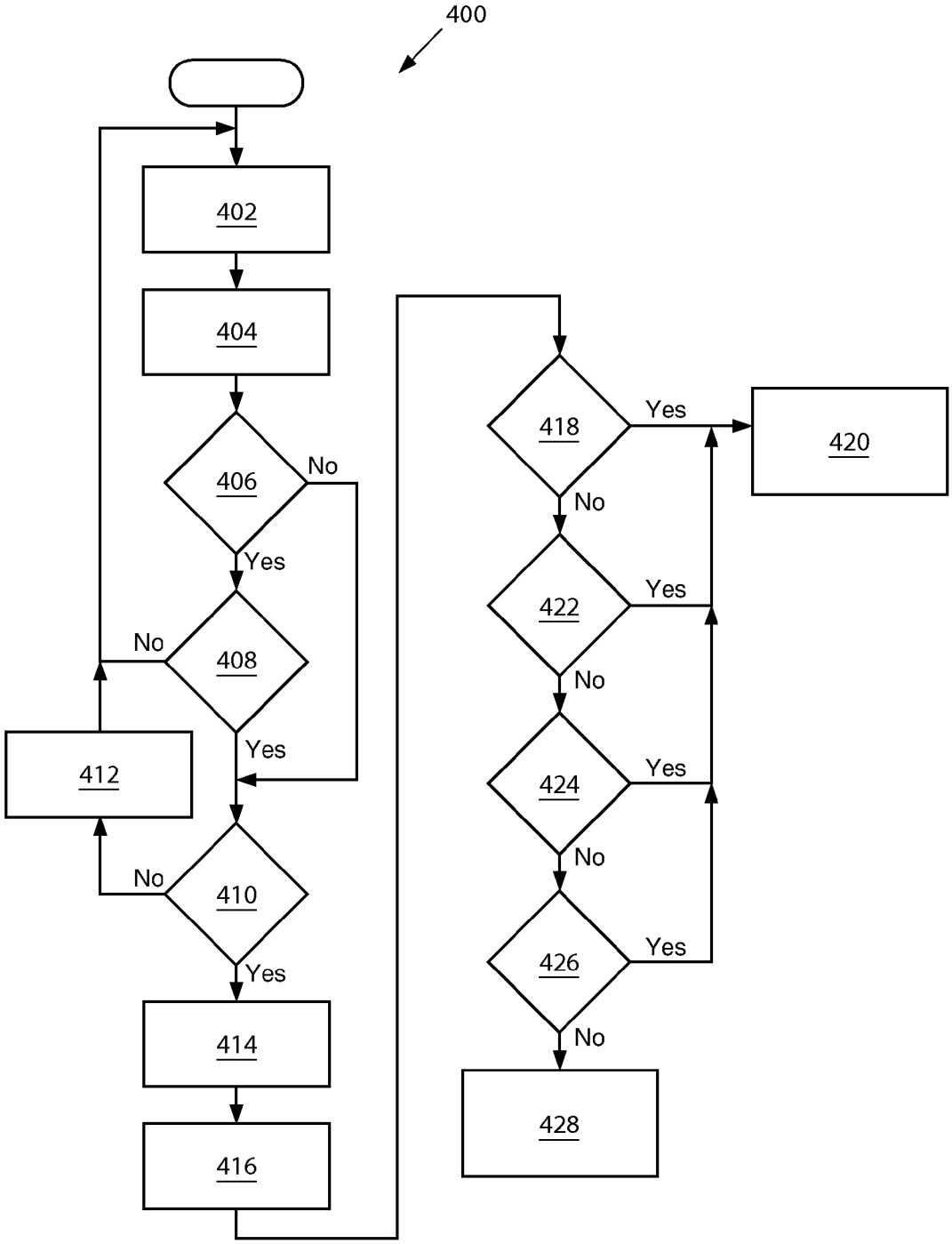
FIG. 4 is a flow diagram illustrating one embodiment of an object warning system in accordance with an exemplary embodiment of the present disclosure.

FIG. 4 illustrates an exemplary embodiment of the object warning system and the method of detecting a proximate object and providing a warning to the operator based on the distance of the object relative to the machine (400). The controller 110 is adapted to determine a ground speed (Step 402). The controller 110 is further adapted to determine a gear selection (Step 404). For example, the controller 110 may receive a gear selection signal or command that represents at least one of a reverse signal for moving the machine 100 in a reverse driving direction or a forward signal for moving the machine 100 in a forward driving direction. If the ground speed is greater than zero (Step 406; Yes) and the gear selection is forward (Step 408; No), the object warning system 108 may be operable in the transition state or the standby state as discussed in more detail above. For example, if the machine 100 has traveled for more than about 20 meters, the object warning system 108 operates in the standby state.

If the ground speed is not greater than zero, in other words, if the machine 100 is idle (Step 406; No) or if the ground speed is greater than zero (Step 406; Yes) and the gear selection is reverse (Step 408; Yes), the controller 110 is adapted to determine if the object 102 is detected (Step 410). If no object 102 is detected (Step 410; No), then the display 300 is updated (Step 412) to show the solid green block in Y3 as discussed above. If the object 102 has been detected (Step 410; Yes), the controller 110 is adapted to receive a camera image (Step 414) of the object 102 to use with updating the display 300 according to a caution level zone and to determine the stopping distance of the machine 100 relative to the detected object 102 (Step 416).

If the stopping distance is greater than a predetermined first threshold (Step 418; Yes), such as, for example approximately eight meters for certain machines, for example, a motor grader, the controller 110 operates to update the display 300 to correspond to the first caution level zone (Step 420). The first caution level zone starts at the first threshold stopping distance and ends at the distance at which the object 102 is no longer within coverage of the radar 112, 114, 116, 118 (i.e. returning to Step 410; No).

If the stopping distance is less than the first threshold (Step 418; No) but greater than a predetermined second threshold (Step 422; Yes), such as, for example between approximately six to eight meters for certain machines, for example, the motor grader, the controller 110 operates to update the display 300 to correspond to the second caution level zone (Step 420).

If the stopping distance is less than the second threshold (Step 422; No) but greater than a predetermined third threshold (Step 424; Yes), such as, for example between approximately four to six meters for certain machines, for example, the motor grader, the controller 110 operates to update the display 300 to correspond to the third caution level zone (Step 420).

If the stopping distance is less than the third threshold (Step 424; No) but greater than a predetermined fourth threshold (Step 426; Yes), such as, for example between approximately two to four meters for certain machines, for example, the motor grader, the controller 110 operates to update the display 300 to correspond to the critical zone (Step 420). If the stopping distance is less than the fourth threshold (Step 426; No), such as, for example less than two meters for certain machines, for example, the motor grader, the controller 110 operates to update the display 300 to correspond to the stop zone (Step 428).

It will be apparent to those skilled in the art that various modifications and variations can be made to the method and system of the present disclosure. Other embodiments of the method and system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. An object warning system for a machine, comprising:
an object detection system;
an operator interface including a visual display; and
a controller in communication with the object detection system and the operator interface, the controller configured to control the display to represent a warning level as a function of a status of the machine and a distance of an object relative to the machine;
wherein the status of the machine includes at least one of a ground speed of the machine or a gear selection of a transmission of the machine;
wherein the distance is a stopping distance based in part on the ground speed and a location of the object, and a visual representation corresponding with the stopping distance defines the warning level;
wherein the controller is configured to control a first portion of the display to communicate the warning level; and
wherein the warning level includes a first level associated with at least one of a first stopping distance of the object or a no object detected status.

2. The warning system of claim 1, wherein the warning level includes a first color associated with the first level if the warning level is associated with the first stopping distance of the object and the warning level includes a second color if the warning level is associated with the no object detected status.

3. The warning system of claim 2, wherein the warning level includes a second level associated with a second stopping distance of the object.

4. The warning system of claim 3, wherein the warning level includes a third level associated with a third stopping distance of the object.

5. The warning system of claim 4, wherein the warning level includes the first color associated with the second level if the warning level is associated with the second stopping distance and includes the first color associated with the third level if the warning level is associated with the third stopping distance.

6. The warning system of claim 5, wherein the warning level includes a fourth level associated with a fourth stopping distance of the object.

7. The warning system of claim 6, wherein the warning level includes a third color associated with the fourth level if the warning level is associated with the fourth stopping distance, wherein the third color is blinking at a frequency.

8. The warning system of claim 7, wherein the warning level includes a fifth level associated with a fifth stopping distance of the object and the warning level includes the third color associated with the fifth level, and the third color is constant if the warning level is associated with the fifth stopping distance.

9. The warning system of claim 8, wherein the controller is further configured to provide a sound when the warning level represents at least one of the fourth level or the fifth level.

10. The warning system of claim 9, wherein the sound varies based on the distance of the object relative to the machine.

11. An object warning system for a machine, comprising:

an object detection system, the detection system having at least one camera;

an operator interface including a visual display; and a controller in communication with the object detection system and the operator interface, the controller configured to control the display to represent a warning level as a function of a status of the machine and a distance of an object relative to the machine;

wherein the detection system further includes at least one of a short range radar system, a medium range radar system, or a long range radar system;

wherein a first portion of the display includes the warning level, a plurality of contiguous blocks define the warning level in the first portion, and a second portion of the display includes at least one of a camera view or a radar view;

wherein the distance is a stopping distance based in part on the ground speed and a location of the object, and a visual representation corresponding with the stopping distance further defines the warning level;

wherein the warning level includes a first level associated with at least one of a first stopping distance of the object or a no object detected status, a second level associated with the second stopping distance of the object, a third level associated with a third stopping distance of the object, a fourth level associated with a fourth stopping distance of the object, and a fifth level associated with a fifth stopping distance of the object; and wherein each level corresponds to one of the plurality of contiguous blocks.

12. The warning system of claim 11, wherein the warning level includes a first color associated with the first level in a first contiguous block if the warning level is associated with the first stopping distance, the warning level includes a second color in the first contiguous block if the warning level is associated with the no object detected status, the warning level further includes the first color associated with the second level in a second contiguous block if the warning level is associated with the second stopping distance, includes the first color associated with the third level in a third contiguous block if the warning level is associated with the third stopping distance, includes a third color associated with the fourth level in a fourth contiguous block if the warning level is associated with the fourth stopping distance, wherein the third color is blinking at a frequency, and includes the third color associated with the fifth level in a fifth contiguous block if the warning level is associated with the fifth stopping distance, wherein the third color is constant in the fifth contiguous block.

13. A non-transitory computer readable medium for use with an object warning system for a machine, the computer readable medium having computer executable instructions for performing a method of controlling a display comprising:

monitoring a status of the machine and a distance of an object relative to the machine; and controlling a first portion of the display to represent a warning level as a function of the status of the machine and the distance of the object relative to the machine, and controlling a second portion of the display to provide at least one of a camera view or a radar view;

wherein controlling the first portion of the display to represent a warning level includes providing a visual representation that corresponds to a stopping distance based in part on a ground speed of the machine and a location of the object relative to the machine, wherein the visual representation includes a plurality of contiguous blocks each having a color associated with the stopping distance, the color indicating a varying proximity of the object relative to the machine.

* * * * *